US005775011A

United States Patent [19]

Reitano, Jr.

[11] Patent Number: 5,775,011

[45] Date of Patent: Jul. 7, 1998

[54] SNEAKER WATCH AND HOLDER THEREFOR

[76] Inventor: Joseph J. Reitano, Jr., 39 Perry Ave., Staten Island, N.Y. 10314

[21] Appl. No.: 633,624

[22] Filed: Apr. 17, 1996

[51] Int. Cl.[6] ..... A43B 23/00; G09F 23/00; B65D 85/40

[52] U.S. Cl. ..... 36/136; 36/55; 40/636; 40/661.05; 206/301

[58] Field of Search ..... 36/1, 132, 136, 36/54, 99; 40/636, 27.5, 661.05; 206/301

[56] References Cited

U.S. PATENT DOCUMENTS

| | | | |
|---|---|---|---|
| 1,381,950 | 6/1921 | Van Deusen | 36/54 X |
| 4,455,764 | 6/1984 | Rock et al. | 36/136 |
| 4,536,975 | 8/1985 | Harrell | 36/136 |
| 4,559,730 | 12/1985 | Burrell | 40/661.05 X |
| 4,605,050 | 8/1986 | Suk | 40/661.05 X |
| 4,897,947 | 2/1990 | Kass-Pious | 40/636 |
| 5,313,719 | 5/1994 | Koethe | 36/136 X |
| 5,566,477 | 10/1996 | Mathis et al. | 36/132 X |

*Primary Examiner*—B. Dayoan
*Attorney, Agent, or Firm*—Colucci & Umans

[57] ABSTRACT

A display unit such as a digital or analog watch is held in a wedge-shaped member to the top of footwear by a second tongue held, for example, with hook and loop fasteners, to the top of a sneaker or shoe. In another embodiment, the display unit can be held to the top of footwear by the laces of the footwear, which are threaded through a series of pairs of openings in the bottom of the display holder.

20 Claims, 7 Drawing Sheets

SNEAKER WATCH AND HOLDER THEREFOR

FIELD AND BACKGROUND OF THE INVENTION

The invention relates in general to footwear, and in particular, to a new and useful timepiece which can be used with, combined with or form a portion of footwear, in particular, a sneaker.

Design Pat. No. 285,142 to McArthur discloses a watch on a side of a shoe or sneaker. The watch can be either analog or digital.

Design Pat. No. 337,528 to Hirsch discloses a watch that merely looks like a shoe but is not functional as a shoe and is put on a mantle as a display item. In the Hirsch design patent, the watch or time piece is contained in the toe of the shoe.

Design Pat. No. 339,989 to Parsons discloses a watch with flanges on two sides. Each of the flanges have two holes therethrough and appears to be useful for shoe laces.

U.S. Pat. No. 4,651,456 to Yukawa discloses a pedometer for measuring the steps taking by the wearer. The pedometer is held in place on the shoe by various means. One of the means includes a detachable second tongue held in place by the laces.

In U.S. Pat. No. 4,516,337 to Adamik, a shoe with a side pocket for holding an object is disclosed. The pocket of the shoe has a clear window on the outside so that the object in the pocket is displayed.

U.S. Pat. No. 5,343,445 to Cherdak discloses a timer display built into the tongue of a shoe.

Other patents of interest include U.S. Pat. Nos. 4,466,204 to Wu and 4,891,797 to Woodfalks. These two patents disclose other means of mounting sensors or timers and displays onto a shoe. The Wu '204 patent discloses a display built into the toe of the shoe as opposed to an addition, after the shoe is built. The same can be seen with the Woodfalks '797 patent which has a timer counter built into the sole of the shoe.

U.S. Pat. No. 5,099,462 to Karowski discloses the attachment of a watch to a different piece of apparel, namely a hat.

SUMMARY OF THE INVENTION

The present invention comprises a timepiece holder for use in holding a timepiece to a shoe, sneaker or other footwear, at an advantageous orientation for viewing by the wearer. In this disclosure, terms such as shoe, sneaker and footwear, are meant to include any type of footwear and are not intended to limit the present invention to a particular type of footwear. Further, the term shoes is meant to include sport shoes and even boots and work shoes. Advantageously, however, the invention is most suitable for sports related footwear such as running shoes and a wide variety of athletic shoes currently on the market.

The invention also extends to pocket arrangements for attaching the timepiece holder to the footwear.

The term timepiece is also used in a non-limiting manner to include wristwatches (less their usual wristbands), pocketwatches and other timepieces. According to further embodiments of the invention, the timepiece may even be a stopwatch or even a display unit which includes other information displaying structures such as a pedometer, thermometer, compass, altimeter, or combinations thereof.

The invention includes means for securely attaching the timepiece holder to a shoe sneaker or other footwear which is easy to use. A series of slits on the back of the timepiece holder are provided for threading laces of the shoe or sneaker therethrough and thereby securing the holder to the front of the shoe. Several slits are provided in order to accommodate different footwear styles.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
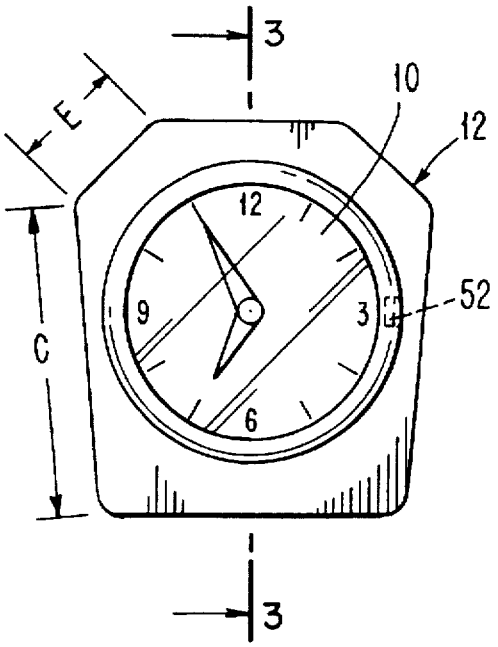
FIG. 1 is a top plan view of a holder for use with a display unit according to a preferred embodiment of the present invention.
Figure 2:
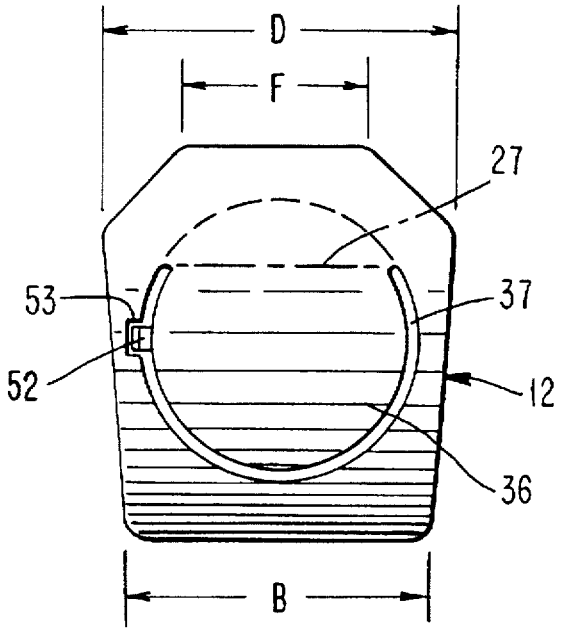
FIG. 2 is a bottom plan view thereof.
Figure 3:
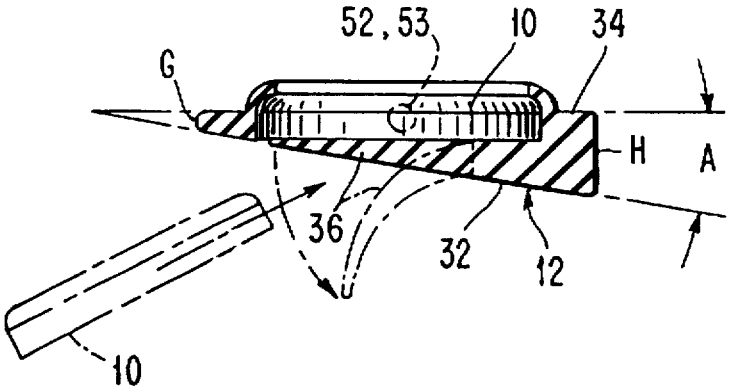
FIG. 3 is a sectional view, partly in elevation, taken along line 3—3 of FIG. 1.

Referring to the drawings, in particular, the invention embodied in FIGS. 1–3, comprising a wedge-shaped holder 12 advantageously made of a single piece of firm yet flexible and resilient material such as natural or synthetic rubber, which contains a display unit such as a timepiece 10.

Figure 4:
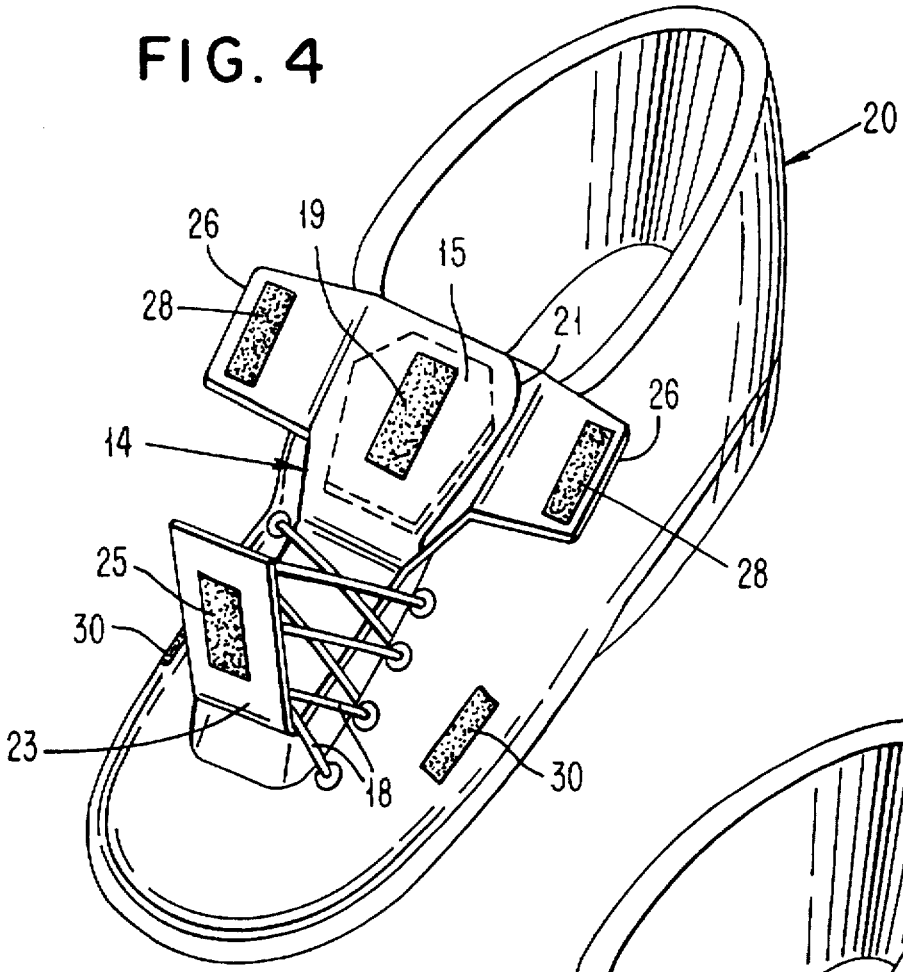
FIG. 4 is a perspective view of a pocket unit according to a further embodiment of the invention, during an early stage of attachment to a sneaker.
Figure 5:
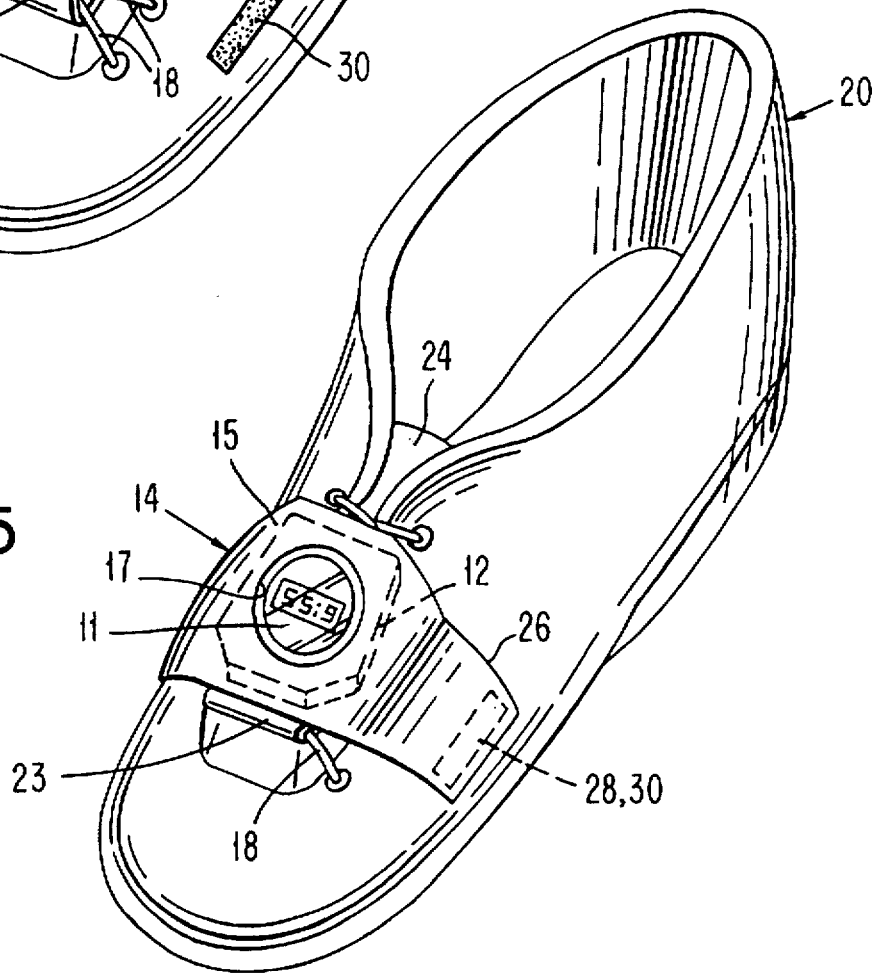
FIG. 5 is a view similar to FIG. 4 showing a final stage of attachment for the embodiment of FIG. 4.
Figure 6:
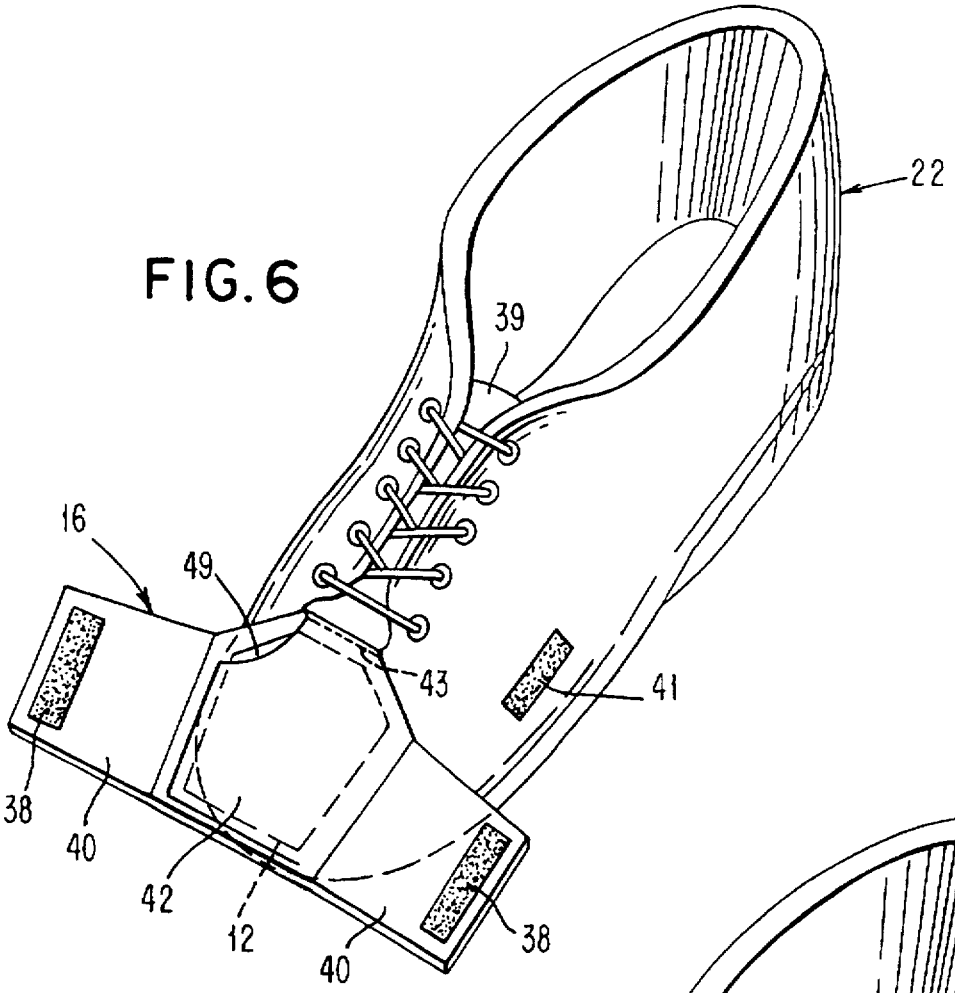
FIG. 6 is a view similar to FIG. 4 of a second embodiment of the pocket unit which is sewn to a sneaker to, in effect, form a second tongue from the sneaker.
Figure 7:
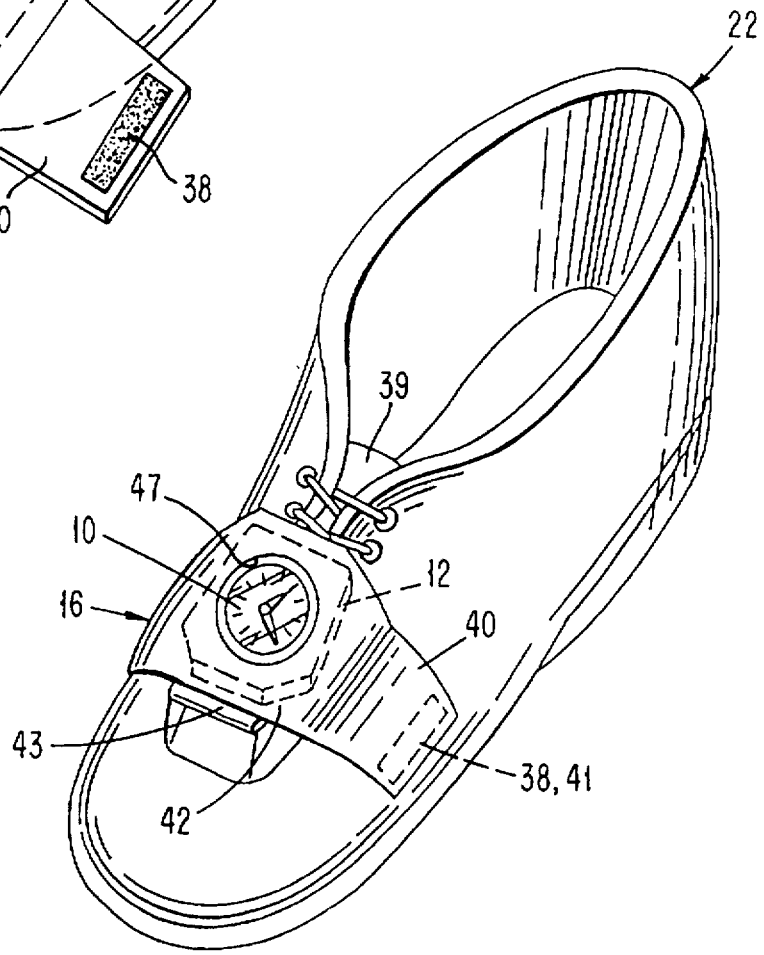
FIG. 7 is a perspective view similar to FIG. 6 of the pocket unit in its final position on the sneaker.

FIGS. 4 and 5 illustrate the first embodiment of a pocket unit or second tongue generally designated 14 which is constructed so that it can be attached to the lacing or closure straps of a piece of footwear generally designated 20. FIGS. 6 and 7 illustrate a second embodiment of the pocket unit, generally designated 16, which is meant to be permanently attached, much like a second tongue, to a sneaker or other footwear generally designated 22.

The purpose of attaching a timepiece or display unit to a sneaker is to allow a user involved in a sporting activity (such as basketball) to have easy access to the time without wearing an uncomfortable wristwatch. A timepiece on a shoe (such as construction boots) is part of this invention because an ordinary wristwatch may not be comfortable in construction work either.

One embodiment of the invention uses three parts. The first part is the watch display unit or timepiece proper, shown at 10 in FIG. 1, with a display face. The second part is the holder 12 that the watch is inserted into. The last part is the pocket unit 14 in FIG. 4, that includes a cover and strap (referred to as the sneakers'second tongue) that the watch and holder inserts into and then attaches to the sneaker 20.

As seen in FIGS. 4 and 5, the second tongue 14 has a lace strap 23 that attaches to the sneaker around its lowest portion of laces 18 and is held in place with hook and loop fasteners (i.e., VELCRO fasteners) at 25 on strap 23, and 19 on the underside of pocket portion 15. Whereas the first tongue 24 is designed to sit below the laces 18 (as with all sneakers), the second tongue 14 is designed to sit over the laces. When strapped down the second tongue will sit approximately 2 inches up the sneaker (from the lowest lace) and be held in place with side straps 26 and side fasteners 28 on strap 26 and 30 on sneaker 20. The second tongue 14 has a 1¾" diameter top opening 17 in the upper surface of pocket portion 15 (closest to the front of the sneaker) so that a digital watch 11 can be seen easily in its final position. Pocket portion 15 also has a bottom side opening 21 for receiving the holder 12.

Opening 21 is on the right side of the back of pocket portion 15 to allow the watch and holder to be inserted and removed. For this reason, the second tongue is made from a thick, sturdy, elastic nylon cloth and leather to accept the watch and holder and keep it in place. The sneaker watch has been designed to allow the watch and holder to be removable so a consumer will be able to (a) change the battery in the watch, (b) repair the watch if need be, (c) change the watch to a more desirable one, and/or (d) remove the watch and holder completely for a period of time. In this last scenario, the second tongue would strap down to the sneaker for revealing a logo that may be sewn behind the opening 17.

FIG. 4 shows lace strap 23 to have a first portion under laces 18 and a second portion, folded over the lower lace and carrying fastener 25. In FIG. 5, pocket portion 15, that is attached at a fold line to the first portion of strap 23, is folded over to correct fastener 19 to fastener 25.

As you can see in FIGS. 1, 2 and 3 the watch faces will be approximately 1 9/16" in diameter ⅜" thick and of various designs. The common component of all the watches whether analog or digital will be that (1) they are large enough to be seen easily on the sneaker and (2) they will be shock resistant to allow use in sporting activities.

As seen in FIGS. 1, 2 and 3, the watch 10 sits inside the hardened, but pliable rubber or plastic holder 12 that will fasten it in place so it can be inserted into the second tongue of the sneaker. Dimensionally, the holder 12 has a lower dimension B of approximately 1⅝" wide with rounded corners, running upwardly and out on both side of dimension C at about 1⅞" to approximately 1⅞" wide at D and then upwardly and in on both sides at E, approximately ⅝" with a straight 1" top across F. The holder is about 2⅛" from bottom to top in the center. The holder will be approximately 3/32" thick at the bottom G getting gradually thicker toward the top until approximately 7/16" thick at H. The wedge shape due to the thickness at the top of the holder is designed to compensate for the incline at the top of the sneaker and put the watch face into a users line of sight. Angle A between lower surface 32 and upper surface 34 is about 10°, or between 5° and 20° so that the display face is angled toward the user's eyes, despite the inclined top surface of the user's shoe which will carry the watch.

The top-center of the holder has an indented cut-out in the shape of the watch and approximately 1 9/16" in diameter and 3/16" deep. The front portion of the opening extends upward 3/16" as to make up the ⅜" depth needed for the watch thickness. A ⅛" lip is located at the top of the extended portion to hold the watch from popping upward and out of the holder. Lastly, to the right and left sides of the opening there is 1/16" excess material, to the bottom of the opening ¼" material and to the top of the opening ⅛" material.

In order to load the watch as shown in FIG. 3, into the holder, there is a lid 36 attached to or formed as part of the back of the holder that lifts out on its bend line 27 as shown in phantom line in FIG. 3. The lid is attached by approximately 1⅛" material at the top of the back of the opening. There is a 1/16" slit 37 around the circumference of the remaining opening to allow the lid to be pulled out. The watch is slid into the holder from the rear and held snugly in place by the lid. The back lid is pushed closed and held in place when loaded into the second tongue of the sneaker. The side wall of the cavity also has a recess 53 for the stem or windup/setting mechanism 52 of watch 10.

In FIGS. 4 and 5, the second tongue 14 of the sneaker 20 has two male (hook) VELCRO straps 28 sewn to it. The straps extend from each side of the tongue and attach to the strategically placed corresponding female (loop) VELCRO straps 30 placed on both sides of the sneaker by the user with the use of double faced adhesive or tape, for example. The strap is designed so that, when both extensions are pulled snugly back and down the sides of a sneaker as in FIG. 5, the watch and holder is securely fastened to the sneaker and easily visible to the consumer.

Note that wedge shaped holder or marker 12 is polygonal so that it will not rotate in the pocket portion.

As seen in FIGS. 6 and 7, a second embodiment of the second tongue 16 of the sneaker 22 has two male or hook fasteners 38 sewn on side straps 40. The straps extend from each side of a pocket portion 42 of the tongue and attach to strategically placed corresponding female or loop parts 41 sewn on both sides of the sneaker 22. The strap is designed so that, when both extensions are pulled snugly back and down the sides of the sneaker, the watch 10 and holder 12 is securely fastened to the sneaker and easily visible to the user. Note that with the addition of this second tongue, a unique design to the sneaker follows. Aside from the unique dimensions and the strap's attachment design of the second tongue, the second tongue and straps will have the sneaker logo and various designs sewn into it. The base of pocket portion 42 is sewn at 43 to the base of the original sneaker tongue 39. Pocket portion 42 has front or top openings 47 to view watch 10, and rear opening 49 to receive holder 12.

Figure 8:
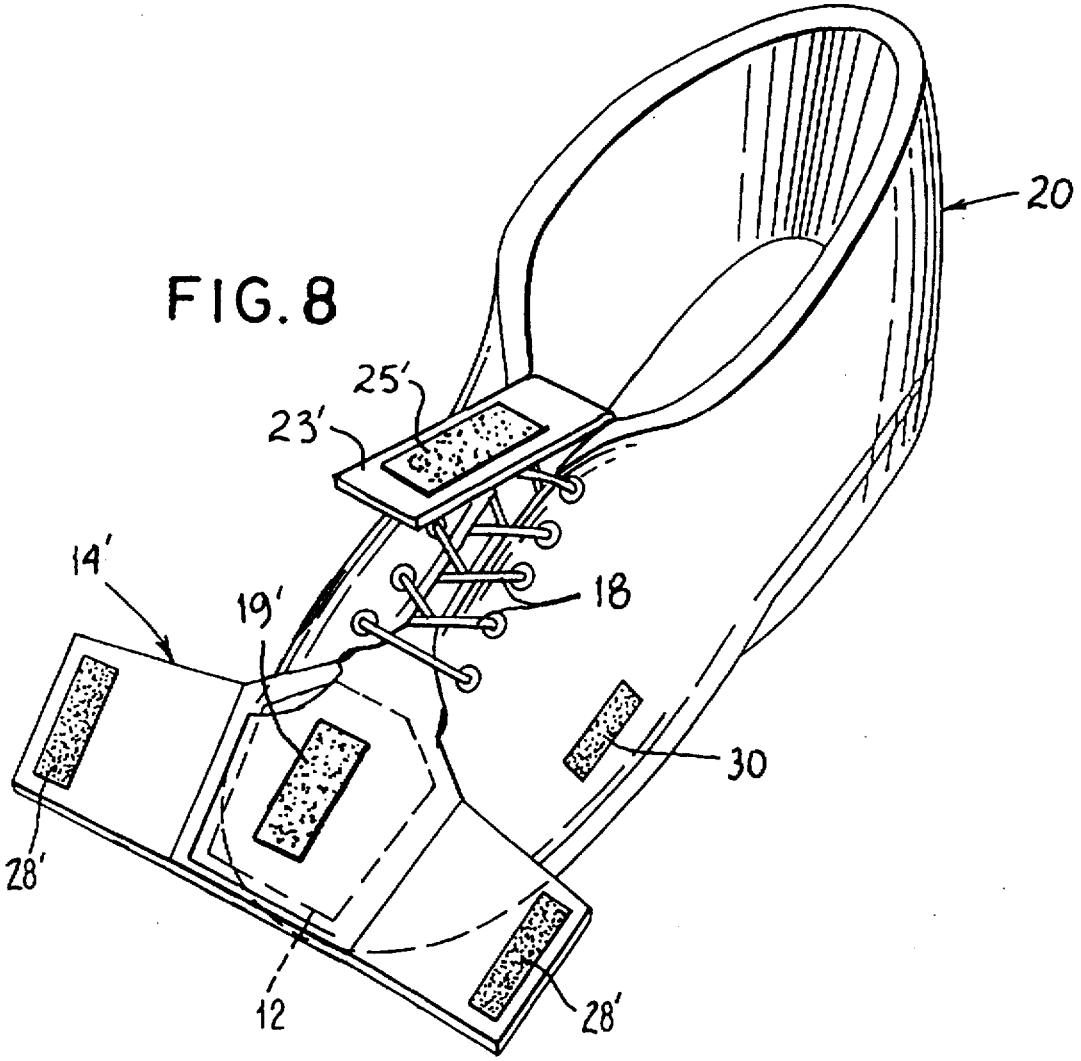
FIG. 8 is a view similar to FIG. 6 of another embodiment of the invention.

A further preferred embodiment of the invention is shown in FIG. 8 which is similar to the embodiment of FIG. 4 except that the strap 23' is inserted under laces 18 from the toe end of the sneaker 20. Like the embodiment of FIG. 4, the embodiment of FIG. 8 includes a fastener 19' on the underside of the second tongue 14', which engages fastener 25' on the end of the strap 23'. Again as with the embodiment of FIG. 4, the embodiment of FIG. 8 includes side straps which each carry side fasteners 28' that engage fasteners 30 on the side of the sneaker 20. In the assembled condition, the embodiment of FIG. 8 looks much like the view of FIG. 5.

Figure 9:
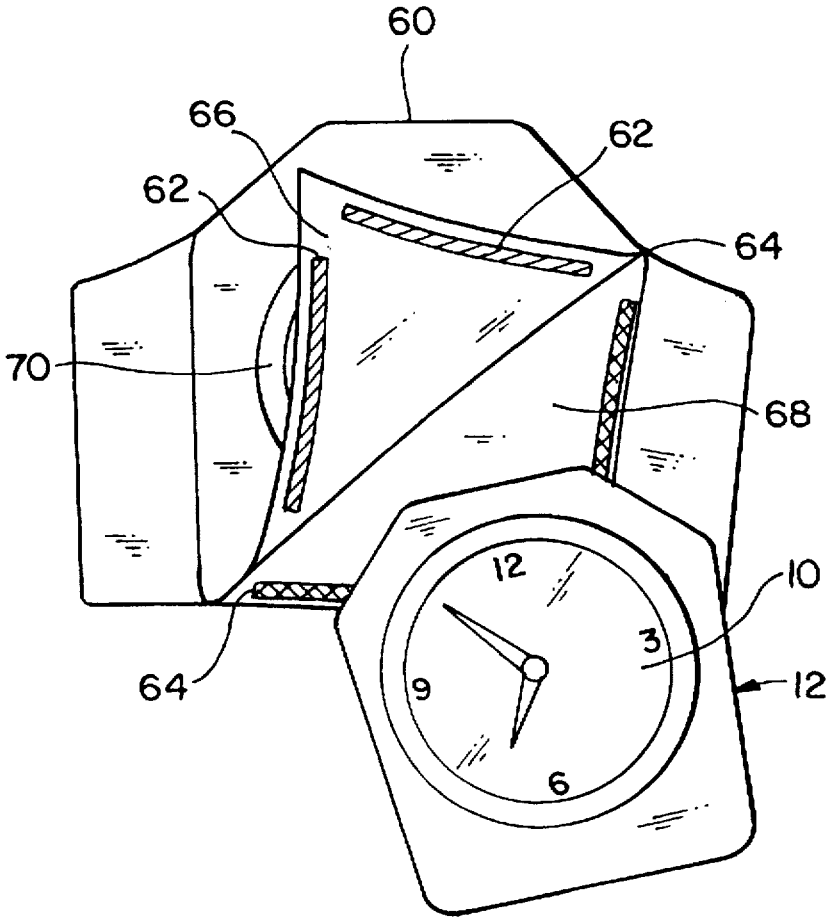
FIG. 9 is a perspective view of a third embodiment of the pocket unit for attaching to a sneaker.

In yet another embodiment of the present invention shown in FIG. 9, a holder pocket 60 has a detachable flap which may be alternately lifted or fastened to allow the insertion or removal of timepiece 12. The pocket 60 is formed by top piece 66 and bottom piece 68, which are sewn together on their top and left edges. However, on their bottom and right edges they are left open, and instead, hook and loop fastener strips 62 are securely attached to top piece 66 and corresponding hook and loop fastener strips 64 are securely attached to bottom piece 68. Hook and loop fastener strips 62 are positioned so that when top piece 66 is properly aligned with bottom piece 68, the hook and loop fastener strips 62 and 64 meet and close the holder pocket 60. Holder pocket 60 also has face opening 70 in top piece 66 for displaying timepiece 10 while it is inserted within pocket 60.

Figure 10:
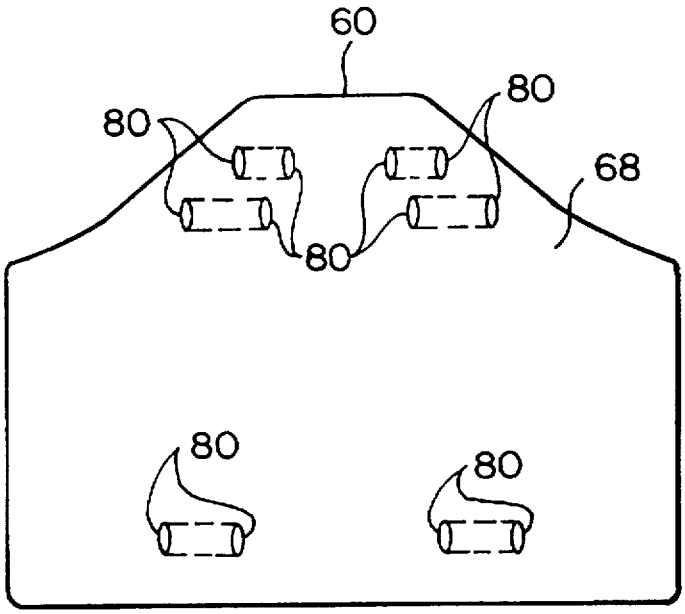
FIG. 10 is a bottom plane view of the pocket shown in FIG. 9.
Figure 11:
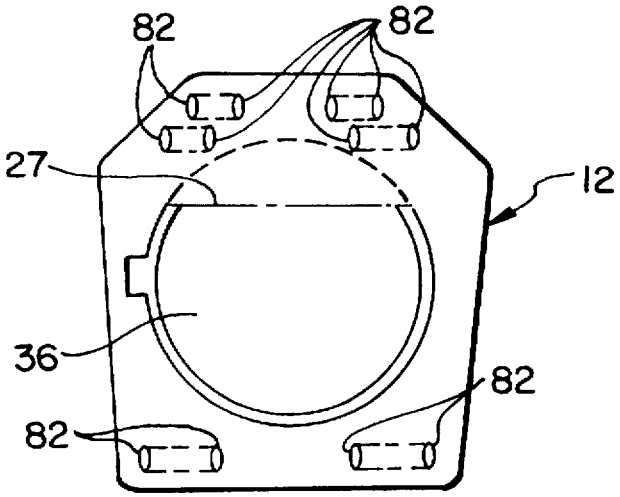
FIG. 11 is a bottom plane view of a second embodiment of the holder shown in FIGS. 1 and 2.
Figure 12:
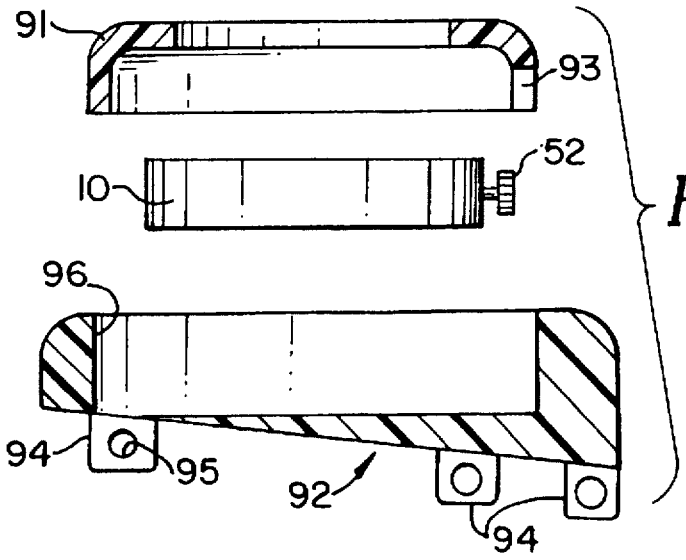
FIG. 12 is a side sectional exploded view of a further embodiment of the invention.

FIG. 10 shows a different means for connecting the holder pocket 60 to a sneaker or other footwear. Holder pocket 60 has a plurality of slit openings 80 on bottom piece 65 which are large enough to allow a shoe lace through. The slit openings are arranged in pairs so that a shoe lace may be pushed through each pair of openings. The openings 80 are located at different positions on the back of bottom piece 68.

It is envisioned that the user will lace the bottom lace of their sneaker through either the first two pairs of openings 80 or the second two pairs of openings located near the top of bottom piece 68. The choice of which two pairs of openings to use will depend on where the bottom lace of the user's sneaker is located, since it is important to have the upper most portion of the invention situated as close to the bend in the sneaker as possible. If the invention sits too high on the sneaker, it will be difficult to see, while conversely, if the sneaker watch sits to low on the sneaker, it will be uncomfortable to wear.

Once the initial set of openings 80 are laced, the user will then continue to lace the sneaker normally until they have reached the remaining two pairs of openings 80 near to the lower portion of bottom piece 68. The user will then thread the laces through these two pairs of openings 80 in order to finish securing the invention to the sneaker. The user can then continue to lace the sneaker normally.

The slit openings 80 may be cut directly out of bottom piece 68, or in a further embodiment of the invention, they may be formed by sewing additional pieces of leather or other suitable material to bottom piece 68. The additional material thus forms channels for the laces of a sneaker to be threaded through. Additionally, the positioning of the openings 80 may be altered in order to be more advantageously located for different types of footwear.

Additionally, in a further embodiment of the holder 12, shown in FIGS. 1–3, FIG. 11 shows a holder 12 incorporating slit openings 82 similar to those used on the separate holder pocket 60 of FIG. 10. The slit openings 82 on the holder 12 may either be formed within the material from which the holder 12 is made of or they may be formed of additional material added to the holder 12 and thus comprise channels to insert shoe laces through.

The openings 82 on holder 12 are used in a manner similar to openings 80 of back piece 68. Holder 12 is the same in all other respects and has lid 36 and fold line 27 for use in inserting a timepiece 10, not shown, into the holder 12.

Figure 13:
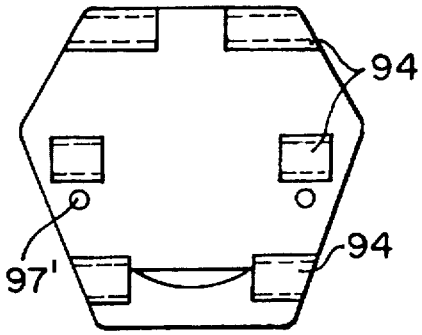
FIG. 13 is a rear elevational view thereof.

Referring to FIGS. 12–15, another embodiment of the invention comprises a rigid wedge shaped holder 92 having a bottom surface with a plurality, in this case 6, projections 94, each with a transverse hole 95 for receiving a shoe lace. A cylindrical bore 96 on the front surface of the wedge-shaped member receives a watch 10 and is held to the wedge by a cylindrical bezel 91 which is press fit into the bore 96. The bezel includes a circumferential flange having a recess 93 for accommodating the wind-up steam 52 and for rotationally fixing the watch in the bore 96. As shown in FIG. 13, a pair of holes 97' are provided in the rear surface of the holder. These holes communicate with the bore 96 so that the watch and bezel can be pushed from the bore, e.g. for changing the watch or changing a battery in the watch.

Figure 14:
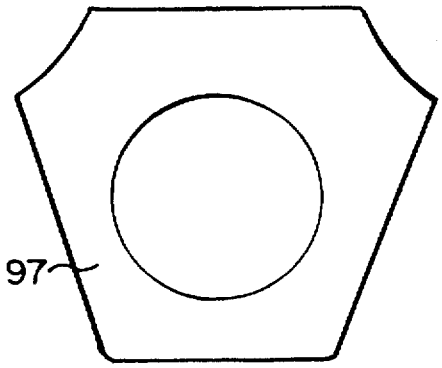
FIG. 14 is a top plan view of a pocket for use with the embodiment of FIG. 12.
Figure 15:
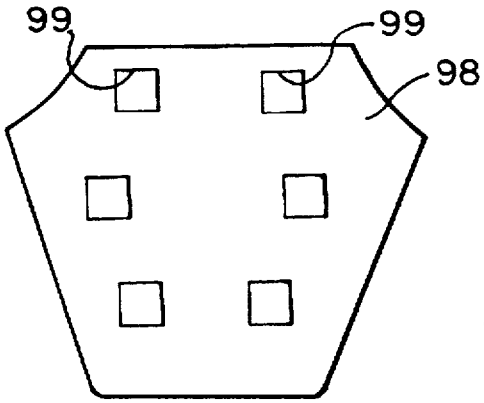
FIG. 15 is a rear elevational view of the pocket of FIG. 14.

The watch is held to the top of a sneaker or shoe by first placing the watch inside a pocket having a front member shown at 97 in FIG. 14, having a circular opening for exposing the face of the watch, and a rear layer shown at 98 in FIG. 15, having a plurality of openings 99 corresponding the projections 94 so that with the holder in the pocket and the projections 94 extending through the openings 99, laces from the sneaker or shoe can be threaded through the transverse openings in projections 94, fixing the pocket and watch to the shoe. The top and bottom layers 97, 98 of the pocket can be sewn around part of their periphery to leave an opening for receiving the holder.

While specific embodiments of the invention have been shown and described in detail to illustrate the application of the principles of the invention, it will be understood that the invention may be embodied otherwise without departing from such principles.

What is claimed is:

1. A display unit holder assembly for holding a display unit having a display face, to footwear having an inclined top, the assembly comprising:

a wedge-shaped member having a bottom surface for positioning adjacent the inclined top of the footwear, and a top surface which is at an acute angle to the bottom surface for at least partly compensating for the inclined top when the wedge-shaped member is on the inclined top, the wedge-shaped member including a cavity for receiving the display unit and top opening communicating with the cavity for exposing the display face; and attachment means for attaching the wedge-shaped member to the inclined top of the footwear.

2. A holder assembly according to claim 1, including a movable lid connected to the wedge-shaped member and covering the cavity for retaining a display unit in the cavity.

3. A holder assembly according to claim 2, wherein the wedge-shaped member with lid are made from one piece of pliable material.

4. A holder assembly according to claim 3, wherein the lid is separated from the cavity by an arcuate slot, and is attached to the wedge-shaped member by a bend line.

5. A holder assembly according to claim 1, wherein the wedge-shaped member includes sides which diverge from a top end toward a bottom end of the wedge-shaped member and toward a thick end of the member defined between the top and bottom surfaces.

6. A holder assembly according to claim 5, wherein the cavity is substantially cylindrical, the wedge-shaped member including a ridge around the top opening of the cavity for retaining a display unit in the cavity, and a lid at a bottom end of the cavity for closing the bottom end of the cavity and retaining a display unit in the cavity.

7. A display unit according to claim 6, wherein the display unit comprises a timepiece with a setting stem, the wedge-shaped member including a recess in a side wall of the cavity for receiving the stem.

8. A holder assembly according to claim 1, wherein the wedge-shaped member is polygonal.

9. A holder assembly according to claim 1, wherein the wedge-shaped member has an upper surface at which the cavity is open, and a bezel press fit into the open cavity for holding a display unit in the cavity.

10. A holder assembly according to claim 1, wherein the footwear has a first tongue, the attachment means comprising a second tongue for the footwear, the second tongue including a pocket portion for receiving the wedge-shaped member, the pocket portion including a top opening for exposing the top opening of the cavity for exposing the display face of the display unit, and a bottom opening for receiving the wedge-shaped member, the second tongue also including a pair of straps extending from opposite sides of the pocket portion and fastener means for attaching the side straps to the top of the footwear.

11. A holder assembly according to claim 10, wherein the second tongue includes a lace strap attached to the pocket portion for extending under laces of the footwear, and additional fastener means between the lace strap and the pocket portion for holding the pocket portion onto the lace strap.

12. A holder assembly according to claim 10, wherein the pocket portion is sewn to a base of the first tongue of the footwear.

13. A holder assembly according to claim 1, wherein the acute angle is between about 5° and about 20° so that a wearer of the footwear can easily see the display face when the display unit is in the wedge-shaped member attached by the attachment means to the footwear.

14. A holder assembly according to claim 1, wherein the attachment means comprises a plurality of passage means in the bottom surface of the wedge shaped member for threading a lace of an article of footwear through.

15. A holder assembly according to claim 1, wherein the attachment means comprises a bottom piece containing a plurality of passage means for inserting a shoe lace therethrough;

a top piece having at least four sides, a top surface, a bottom surface, securely attached to the bottom piece on at least two adjacent sides and having at least two different adjacent sides open, forming a pocket with the bottom piece for receiving the wedge shaped member therein; and securing means for fastening the at least two open sides of the top piece to the bottom piece.

16. A holder assembly according to claim 1, wherein the cavity in the wedge-shaped member is upwardly open for receiving a display unit, a bezel having a central opening for exposing a display unit in the cavity, and a rim press fit with the cavity for holding the display unit to the cavity, the wedge-shaped member having a bottom surface with a plurality of projections extending therefrom, each projection having a transverse opening for receiving a shoe lace.

17. A holder assembly according to claim 16, including a pocket for receiving the wedge-shaped member, the pocket having an upper opening for exposing the opening in the bezel and a plurality of lower openings, each for receiving one of said projections.

18. A second tongue for footwear having a first tongue at a top of the footwear, the second tongue receiving a display unit having a display face to be viewed by the wearer of the footwear, the second tongue comprising:

a pocket portion for receiving the display unit, the pocket portion having an opening for exposing the display face of the display unit when the display unit is in the pocket portion;

a pair of side straps attached to the pocket portion and extending on opposite sides of the pocket portion;

means for connecting one end of the pocket portion to the top of the footwear; and fastener means for fastening the side straps to the top of the footwear on opposite sides of the pocket portion.

19. A second tongue according to claim 18, wherein the means for connecting comprises a lace strap extending from the pocket portion on one end of the pocket portion between the side straps, the lace strap having a first portion for engaging under laces of the footwear and a second portion for engaging over the first portion, and further fastener means between the second portion of the lace strap and the pocket portion for holding the pocket portion onto the second portion of the lace strap.

20. A second tongue according to claim 18, wherein the means for connecting comprise one end of the pocket portion being sewn to a base of a first tongue of the footwear.

* * * * *